United States Patent [19]

Gaule et al.

[11] 4,236,570

[45] Dec. 2, 1980

[54] INGOT SHAPE CONTROL BY DYNAMIC HEAD IN ELECTROMAGNETIC CASTING

[75] Inventors: Gerhart K. Gaule, Elberon, N.J.; John C. Yarwood, Madison; Derek E. Tyler, Cheshire, both of Conn.

[73] Assignee: Olin Corporation, New Haven, Conn.

[21] Appl. No.: 1,730

[22] Filed: Jan. 8, 1979

[51] Int. Cl.[3] ..... B22D 27/02

[52] U.S. Cl. ..... 164/49; 164/147

[58] Field of Search ..... 164/49, 147, 250, 358, 164/444, 89, 82

[56] References Cited

U.S. PATENT DOCUMENTS

| | | | |
|---|---|---|---|
| 3,467,166 | 9/1969 | Getselev et al. | 164/250 |
| 3,605,865 | 9/1971 | Getselev | 164/250 |
| 3,612,151 | 10/1971 | Harrington | 164/89 |
| 3,908,735 | 9/1975 | DiCandia | 164/66 |
| 3,981,352 | 9/1976 | Nurminen et al. | 164/358 |
| 3,985,179 | 10/1976 | Goodrich et al. | 164/250 |
| 4,004,631 | 1/1977 | Goodrich et al. | 164/250 |
| 4,071,072 | 1/1978 | McCubbin | 164/444 X |
| 4,161,978 | 7/1979 | Brooks et al. | 164/49 |

FOREIGN PATENT DOCUMENTS

| | | | |
|---|---|---|---|
| 1481301 | 7/1977 | United Kingdom . | |
| 233186 | 4/1969 | U.S.S.R. | 164/49 |
| 273226 | 6/1970 | U.S.S.R. | 164/49 |
| 502707 | 1/1976 | U.S.S.R. | 164/49 |
| 502702 | 4/1976 | U.S.S.R. | 164/49 |

*Primary Examiner*—Robert D. Baldwin
*Assistant Examiner*—K. Y. Lin
*Attorney, Agent, or Firm*—Victor A. DiPalma; Paul Weinstein

[57] ABSTRACT

A method and apparatus is disclosed for electromagnetic casting of metal and alloy ingots of desired shape having portions of small radius of curvature. An open-ended container or hot-top having spaced internal baffles is placed before the electromagnetic induction station of the casting apparatus to provide desired metal flow patterns. Also disclosed is a downspout having nozzle portions which provide preferred directionality to supplied molten metal.

22 Claims, 9 Drawing Figures

INGOT SHAPE CONTROL BY DYNAMIC HEAD IN ELECTROMAGNETIC CASTING

BACKGROUND OF THE INVENTION

This invention relates to an improved process and apparatus for control of corner shape in continuous or semi-continuous electromagnetic casting of desired shapes such as sheet or rectangular ingots of metals and alloys. The basic electromagnetic casting process has been known and used for many years for continuously or semi-continuously casting metals and alloys.

One of the problems which has been presented by electromagnetic casting of sheet ingots has been the existence of high radius of curvature corners thereon. Rounding off of corners in electromagnetic cast sheet ingots is a result of higher electromagnetic pressure at a given distance from the inductor near the ingot corners, where two proximate faces of the inductor generate a larger field. This is in contrast to the lower pressure at the same distance from the inductor on the broad face of the ingot remote from the corner, where only one inductor face acts.

There is a need to form small radius of curvature corners on sheet ingots so that during rolling cross-sectional changes at the edges of the ingot are minimized. Larger radius of curvature corners accentuate tensile stress at the ingot edges during rolling which causes edge cracking and loss of material. Thus, by reducing the radius of curvature of the ingot at the corners there is a maximizing in the production of useful material.

It has been found in accordance with the present invention that in electromagnetic forming of sheet ingots, enhanced metal flow to the ingot corners resulting in small radius of curvature corners can be accomplished by utilization of a hot-top or open ended container having internal baffles. The hot-top is placed before and adjacent to the electromagnetic casting station and supplies molten metal to said station.

In another embodiment of the present invention enhanced metal flow to the ingot corners is accomplished by utilization of a downspout having multiple nozzles for providing directionality of molten metal to the corners of a hot-top axially aligned with the electromagnetic casting station.

In still yet another embodiment of the present invention enhanced metal flow to ingot corners is accomplished by utilization of a downspout having multiple nozzles for providing directionality of supplied molten metal to the corners of the molten ingot as it is formed in the casting station.

PRIOR ART STATEMENT

An electromagnetic casting apparatus for shaping ingots, comprising a water cooled inductor, a non-magnetic screen, a bottom block, and a manifold for applying cooling water to the ingot is exemplified in U.S. Pat. No. 3,467,166 to Getselev et al. Containment and shaping of the molten metal is achieved without direct contact between the molten metal and any component of the mold with the exception of the bottom block, which is used in the start up and withdrawal of the ingot. Solidification of the molten metal is achieved by direct application of water from the cooling manifold to the ingot shell.

A non-magnetic screen is utilized to properly shape the magnetic field for containing the molten metal in U.S. Pat. No. 3,605,865 to Getselev. In addition to screen utilization, solution of the problem of ingot shape may be sought through electromagnetic field modification utilizing shaped inductors (U.S. Pat. No. 4,004,631 to Goodrich et al.) or by utilizing both screens and shaped inductors (U.S. Pat. No. 3,985,179 to Goodrich et al.).

Another means of enhancing and controlling ingot shape is by utilization of a "hot-top" or open-ended container placed before and adjacent to the electromagnetic casting station, as depicted in U.S. Ser. No. 752,458 filed Feb. 13, 1978 and entitled IMPROVED PROCESS FOR ELECTROMAGNETIC CASTING OF COPPER AND COPPER BASE ALLOYS, which disclosure is hereby incorporated by reference.

A variety of electromagnetic casting devices for shaping ingots are also disclosed in U.S. Pat. Nos. 4,040,467 in Russian Pat. Nos. 233,186; 273,226; 502,702; 502,707 and in British Pat. No. 1,481,301.

Various molten metal supply means for direct chill continuous casting molds are depicted in U.S. Pat. Nos. 3,908,735 to DiCandia and 3,612,151 to Harrington et al. U.S. Pat. No. 3,908,735 discloses supply of molten metal to a walled mold via a discharger provided with two outlet ports which produce a degree of directionalized metal flow, while U.S. Pat. No. 3,612,151 depicts an insulated feed reservoir axially aligned with a walled mold.

SUMMARY OF THE INVENTION

The present invention comprises a process and apparatus for electromagnetic casting of metals and alloys into sheet ingots or other desired shapes having small radius of curvature corners or portions by controlled application of directional dynamic head emanating from a "hot-top" of novel design. The "hot-top" of the present invention utilizes the circulating currents or liquid metal flow inherent to the electromagnetic casting process to direct these currents towards the forming ingot corners, preferably by means of multiple baffles spaced within the "hot-top".

In accordance with another preferred embodiment of this invention the dynamic head toward the ingot corners produced by induced metal flow is reinforced or enhanced by a downspout which utilizes multiple nozzles to direct molten metal flow preferentially into the ingot corners.

According, it is an object of this invention to provide an improved process and apparatus for electromagnetic casting of metals, and alloys into sheet ingots, or other desired shapes, characterized by small radius of curvature corners or portions thereon.

This and other objects will become more apparent from the following description and drawings.

DETAILED DESCRIPTION OF PREFERRED EMBODIMENTS

The foregoing objects and advantages are readily achieved by the present invention through the use of a hot-top having spaced baffles therein. The hot-top is placed before and adjacent the electromagnetic casting station and should be physically and chemically stable at the temperatures at which the molten metal is being cast. Preferably, a hot-top lined with an insulating refractory material should be utilized for best results.

In another embodiment of the invention for foregoing objects and advantages are achieved through the use of a downspout having multiple nozzles which provide directionality to the molten metal toward the corners either of the hot-top or the casting and therefore toward the corners of the ingot being cast.

The process of the present invention is particularly applicable to continuous and semi-continuous electromagnetic casting operations. In the process of the present invention, a molten metal stream is continuously supplied to a hot-top, and upon emanating from the hot-top is continuously shaped and solidified in an electromagnetic casting station. The ingot being formed is withdrawn at the same rate as the molten metal is added to the hot-top.

The electromagnetic casting process and apparatus of the present invention, utilizing as they do baffled hot-tops and/or downspouts having multiple nozzles, present an improvement over the use of typical casting molds and electromagnetic casting stations as utilized in the prior art. Problems in cast sheet or rectangular ingots produced from such prior art methods and apparatus such as formation of high radius of curvature corners, are reduced or eliminated by the process and apparatus of the present invention.

Figure 1:
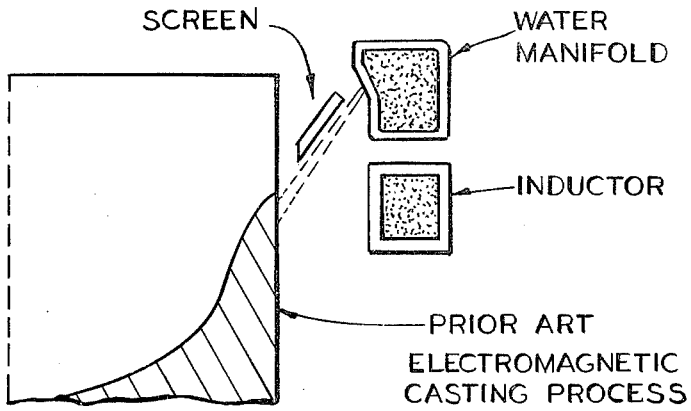
FIG. 1 is a cross-sectional view, in partial schematic form, of the known art, showing the utilization of a water impingement system in combination with an electromagnetic field inductor to provide a solidified ingot.

Referring now to FIG. 1, there is shown a prior art utilization of a water impingement system in combination with an electromagnetic field inductor to provide a casting station for production of a solidified ingot. As can be seen from FIG. 1, the cooling fluid manifold directs a stream of cooling fluid which is deflected by the non-magnetic screen just above said stream to the surface of the emerging ingot. The electromagnetic field inductor is located just below the cooling fluid manifold thereby establishing a field for forming the surface of the molten metal into an ingot, without the use of any mold walls.

Figure 2:
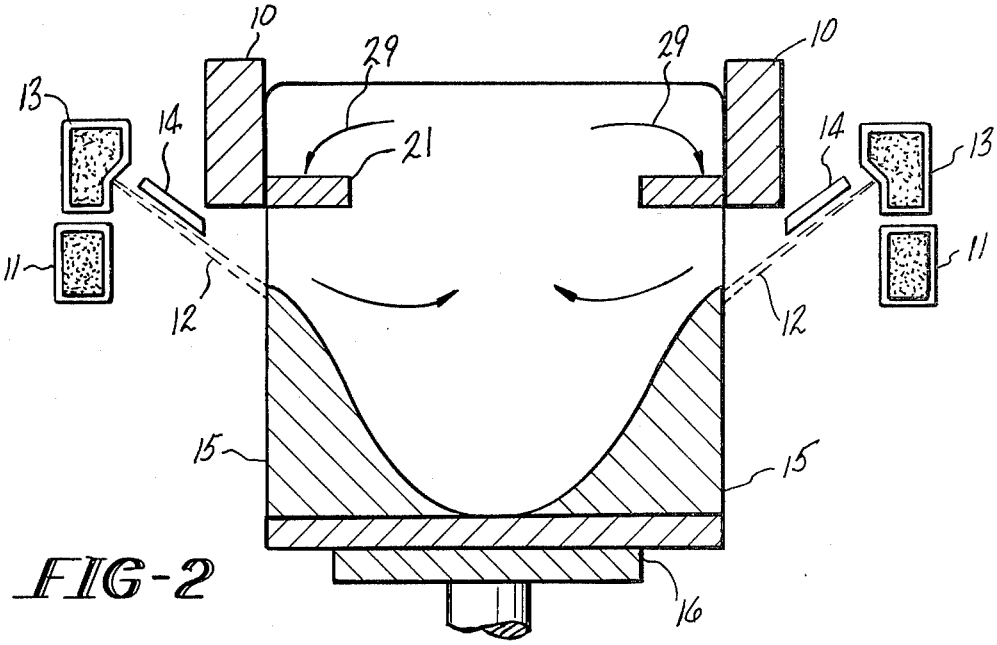
FIG. 2 is a schematic cross-sectional view of the electromagnetic casting apparatus and process of the present invention, utilizing a hot-top having multiple baffles spaced therein.

FIG. 2 illustrates one embodiment of the present invention. As shown in FIG. 2, hot-top 10 of the present invention is placed just before and adjacent electromagnetic casting station 11. A cooling spray 12 from water manifold 13 is deflected by non-magnetic screen 14 to impinge upon emerging ingot 15, thereby cooling and solidifying the ingot as it is withdrawn from the electromagnetic casting station. The emerging ingot 15 has its end attached to stool cap 16 which is in turn attached to conventional withdrawal means (not shown) for movement of ingot 15 from the electromagnetic station. Hot-top 10 is provided with spaced apart baffles 21 which are located on different inner walls of hot-top 10. Baffles 21 are positioned at the bottom and intermediate the corners of hot-top 10.

Solution to the problem of high radius of curvature corners in electromagnetically cast sheet ingots is carried out according to this invention through head or pressure modification. That is, the invention utilizes dynamic head augmentation at the corners of the forming ingots to overcome excess electromagnetic pressure inherent at the corners of the electromagnetically formed sheet ingots. The present invention utilizes the circulating currents or liquid metal flow inherrent to the electromagnetic casting process to augment and redirect these currents downwardly and outwardly toward the forming ingot corners, as shown by flow arrows 29, in a controlled manner. This control of inherent current flow is carried out preferably by means of baffles spaced within the hot-top 10 which is located above and adjacent to the electromagnetic casting station, as shown in FIG. 2.

Figure 5:
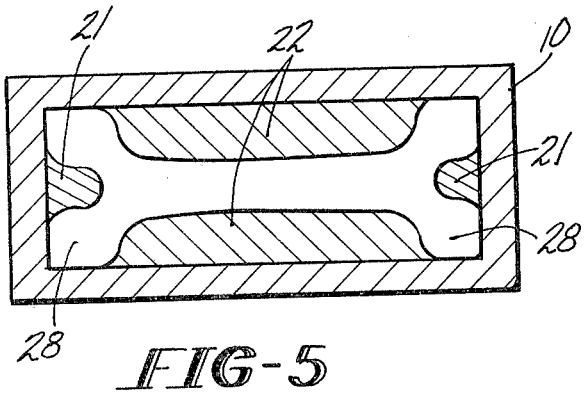
FIG. 5 is a plan view of one embodiment of the hot-top of the present invention, showing two sets of opposed baffles located therein.

FIG. 5 shows a preferred embodiment of hot-top 10 having a second set of spaced baffles 22. Baffles 21 and 22 form reduced areas of downwardly directed flow 28. This reduction in area of flow brings about an increase in molten metal velocity and therefore increased dynamic head. Thus, in accordance with this invention, at the periphery of the forming ingot, the place that sees the highest molten metal velocity or dynamic head is at the corners of the ingot. The result of such preferentially high dynamic head at the corners is a reduced radius of curvature at the emerging ingot corners.

Baffles 21 and 22 may be secured to the walls at the bottom or intermediate the ends of hot-top 10, or they may be formed integral therewith. Hot-top 10 should have approximately the same cross-sectional dimensions as the ingot being cast as is disclosed in U.S. Ser. No. 876,912. Baffles 21 and 22 are shown as having rounded corners inasmuch as it is preferable to make refractory shapes with rounded rather than square corners. In addition, rounded corners provide a somewhat more laminar or smooth metal flow.

Baffles 21 and 22 have a preferred thickness of from about ½" to about 1" and are preferably located greater than about ¼" from the top and bottom of hot-top 10. During the process the distance from the top of baffles 21 and 22 to the top of the molten metal should range from about ¼" to about 3".

Figure 3:
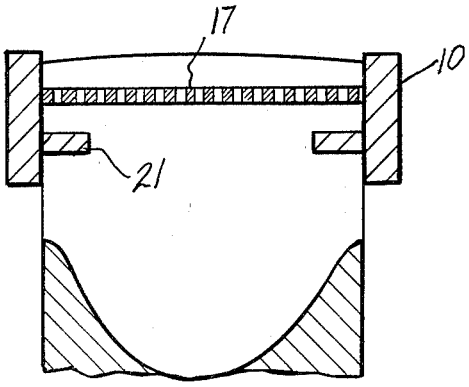
FIG. 3 is a cross-sectional view of a hot-top in accordance with the present invention indicating the placement of an apertured base plate toward one end of the hot-top.
Figure 4:
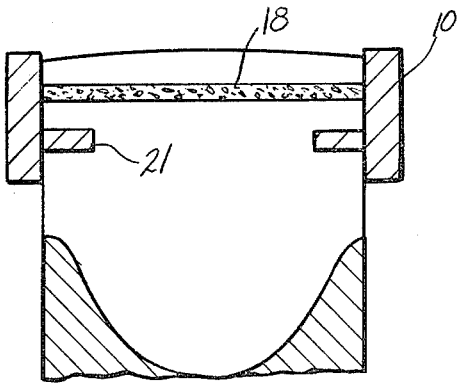
FIG. 4 is a cross-sectional view of a hot-top in accordance with the present invention indicating the placement of a porous ceramic filter toward one end of said hot-top.

FIGS. 3 and 4 show further embodiments of this invention where apertured plate or screen 17 or open pored ceramic foam filter 18 are utilized to span hot-top 10 above the baffles 21. Screen 17 and filter 18 can be utilized to remove undesirable particles from the molten metal stream. Screen 17 and filter 18 can be positioned touching baffles 21 and 22 but are preferably located at least about ¼" from the top surface of the baffles. The top of the molten metal should be greater than about ½" from the top surface of screen 17 and filter 18.

Figure 8:
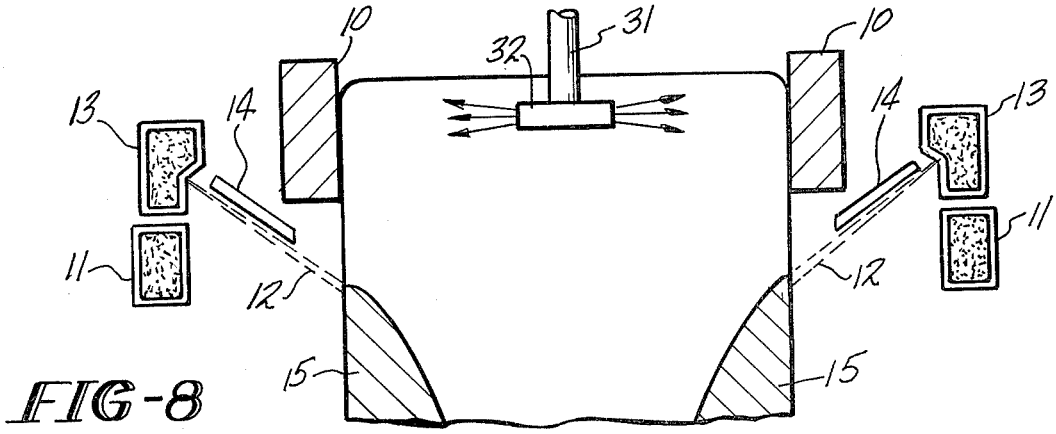
FIG. 8 is a schematic cross-sectional view of the apparatus and process of the present invention showing a flow directing downspout utilzied in combination with a hot-top.

In another embodiment of this invention a downspout 31 is provided with nozzles 32, FIG. 8, and utilized in combination with hot-top 10 to reinforce the dynamic head produced by the electromagnetically induced currents to get higher dynamic head in the corners of the forming ingot. Nozzles 32 are directed at the corners of hot-top 10 and thus direct additional metal flow to the corners of the forming ingot.

Figure 6:
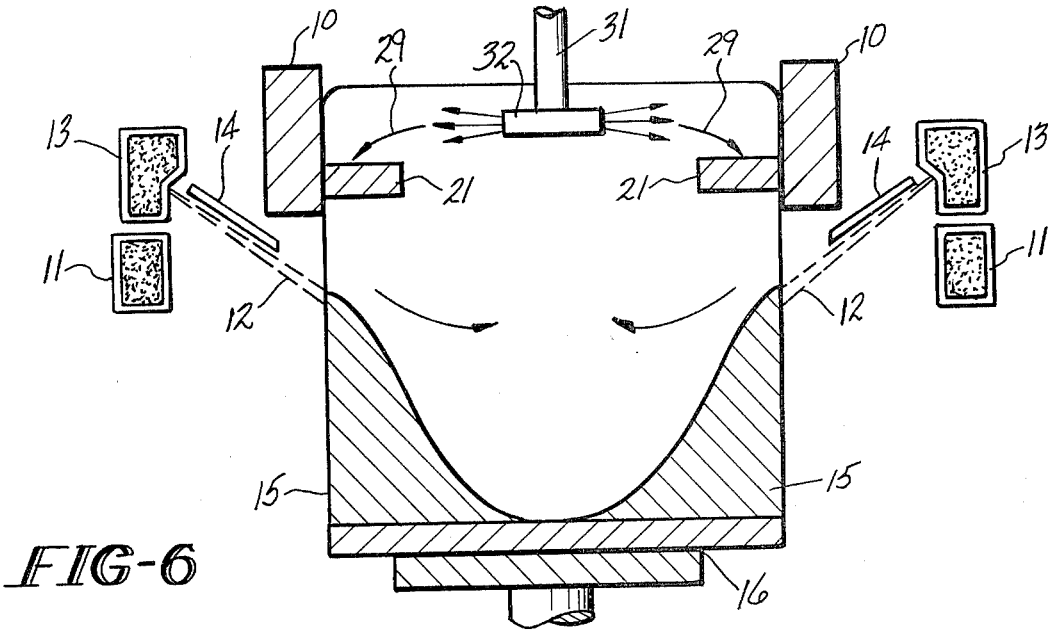
FIG. 6 is a schematic cross-sectional view of the electromagnetic casting apparatus and process of the present invention, showing a downspout having flow directing nozzles in combination with a baffled hot-top.
Figure 7:
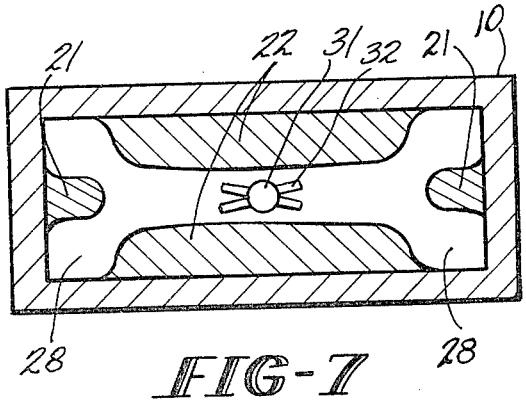
FIG. 7 is a plan view similar to FIG. 5, showing a downspout having flow directing nozzles in combination with a baffled hot-top.

In a preferred embodiment of this invention downspout 31 with nozzles 32 is utilized in combination with a hot-top 10 having opposed baffles 21 and 22 as depicted by FIGS. 6 and 7. Thus in accordance with this invention molten metal flow toward the forming ingot corners is enhanced by a combination of electromagnetic field induced currents, baffle induced or enhanced flow, and downspout nozzle directionalized flow. This preferential metal flow into the ingot corners results in a greater dynamic head at the corners causing the corners to bulge out more, thereby reducing the radius of curvature at the corners of the forming ingot.

Figure 9:
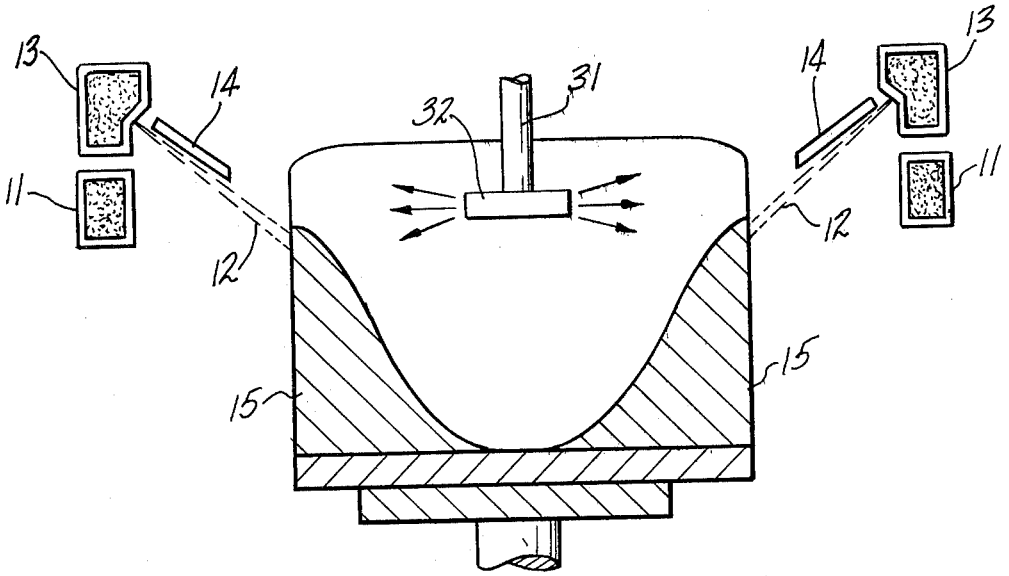
FIG. 9 is a schematic cross-sectional view showing the flow directing downspout of this invention utilized to supply molten metal to an electromagnetic casting section.

In a further embodiment of this invention, downspout 31 with nozzles 32 is utilized within the electromagnetic casting station to supply molten metal to the corners of the emerging ingot 15. The effect of the nozzles 32 is to increase the dynamic head at the corners of the ingot bringing about a reduction in the radius of curvature of said corners. (See FIG. 9). Nozzles 32 are preferably placed at least about ¼" from the top surface of the molten metal during the casting process.

The novel method and apparatus of the present invention find applicability in the electromagnetic casting of any shapes wherein it is desired to form portions thereon of low radius of curvature.

Another advantage of the present invention is the restriction of any protective carbonaceous or molten salt melt covers as well as detrimental surface oxides to the surface of the molten metal within the hot-top 10. The material of said melt covers is thus prevented from becoming trapped in the embryo ingot shell, resulting in improved ingot surfaces. The material of the melt covers, particularly if formed of such material as graphite, is also prevented from interacting with the electromagnetic field. A still further advantage of the present invention is that an inert gas film may be introduced between the hot-top wall and the surface of the molten metal to further protect the metal surface. This inert gas film may be applied peripherally to the hot-top walls through the use of the deflecting screen of the cooling fluid manifold.

All patents and applications described above are intended to be incorporated by reference herein.

It is apparent that there has been provided with this invention novel hot-top and downspout structure for use in electromagnetic casting apparatus which fully satisfy the objects, means and advantages set forth herein before. While the invention has been described in combination with specific embodients thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In an apparatus for electromagnetic forming of molten metals or alloys into a casting of desired shape having at least one portion of small radius of curvature comprising:

means for providing said molten metals or alloys;

means comprising a hot-top for receiving said molten metals or alloys, said hot-top including at least one corner and having approximately the same cross-section as said casting;

means comprising an electromagnetic casting station for forming said molten metals or alloys as they emerge from said hot-top into said casting; the improvement comprising:

means associated with said hot-top adapted for increasing the dynamic pressure of said molten metals or alloys at said hot-top corner by preferentially directing molten metal or alloy flow toward said hot-top corner.

2. An apparatus as in claim 1 wherein said hot-top includes at least one internal baffle for preferentially directing said molten metal or allow flow.

3. An apparatus as in claim 2 wherein said hot-top includes two internal spaced baffles, each of said baffles being located on opposed internal walls of said hot-top.

4. An apparatus as in claim 2 wherein said hot-top includes four internal spaced baffles, each of said baffles being located on individual internal walls of said hot-top.

5. An apparatus as in claim 1 wherein said means for pouring comprises downspout means having at least one nozzle.

6. An apparatus as in claim 2 wherein said means for pouring comprises downspout means having at least one nozzle.

7. An apparatus as in claim 4 wherein said hot-top is of approximately rectangular shape with four corners.

8. An apparatus as in claim 7 wherein said means for pouring comprises downspout means having four nozzles, each of said nozzles providing directionality to the molten metal or alloy being poured into said hot-top toward said corners.

9. An apparatus as in claim 2 wherein said at least one baffle is located at the bottom of said hot-top.

10. An apparatus as in claim 2 wherein said at least one baffle is located greater than about ¼" from the bottom of said hot-top.

11. An apparatus as in claim 9 wherein said hot-top has a height greater than about ¾".

12. An apparatus as in claim 2 wherein said at least one baffle has a thickness of from about ½" to about 1".

13. An apparatus as in claim 1 including means for partially closing the inlet end of said hot-top to provide means for removal of undesirable particles from said poured molten metal or alloy.

14. An apparatus as in claim 13 wherein said means for partially closing the inlet end of said hot-top comprises an open pored ceramic foam filter in spanning engagement with said hot-top.

15. An apparatus as in claim 13 wherein said means for partially closing the inlet end of said hot-top comprises an apertured screen in spanning engagement with said hot-top.

16. In a process for electromagnetic forming of molten metals or alloys into a casting of desired shape having at least one portion of small radius of curvature comprising:

providing a hot-top having approximately the same cross-section as said casting;

pouring said molten metal or alloy into said hot-top;

providing an electromagnetic casting station; and forming said molten metal or alloy into said casting in said electromagnetic casting station as it emerges from said hot-top, the improvement which comprises:

increasing the dynamic pressure of said molten metals or alloys at said portion of small radius of curvature by preferentially directing metal or alloy flow in said forming casting toward said portion of small radius of curvature, whereby a casting of desired shape having said at least one portion of small radius of curvature is formed.

17. A process as in claim 16 wherein said step of increasing the dynamic pressure of said molten metals or alloys is carried out by providing directionality to the molten metal or alloy being poured toward said forming casting portion of small radius of curvature.

18. A process as in claim 17 wherein said casting comprises a rectangular slab ingot and said step of increasing the dynamic pressure of said molten metals or alloys is carried out by providing directionality to said molten metal or alloy being poured toward each corner of said forming ingot.

19. A process as in claim 16 wherein said hot-top is provided with at least one baffle along the internal walls thereof and said step of increasing the dynamic pressure of said molten metals or alloys is carried out by causing metal or alloy to preferentially flow about said at least one baffle.

20. A process as in claim 16 wherein said casting comprises a rectangular slab ingot, and said hot-top is provided with four spaced baffles, each of said baffles being located on individual internal walls of said hot-top, whereby said step of increasing the dynamic pressure of said molten metals or alloys is carried out by causing metal or alloy to preferentially flow about said baffles toward the corners of said forming ingot.

21. In a process for electromagnetic forming of molten metals or alloys into a casting of desired shape having at least one portion of small radius of curvature comprising:

providing an electromagnetic casting station;

pouring said molten metal or alloy into said electromagnetic casting station;

forming said molten metal or alloy in said electromagnetic casting station to form said casting; the improvement comprising:

increasing the dynamic pressure of said molten metals or alloys at said portion of small radius of curvature by preferentially directing said molten metal or alloy flow toward said portion of small radius of curvature as said molten metal or alloy is poured, whereby a casting of desired shape having said at least one portion of small radius of curvature is formed.

22. A process as in claim 21 wherein said casting comprises a rectangular slab ingot and said step of increasing the dynamic pressure of said molten metals or alloys is carried out by providing directionality to said molten metal or alloy being poured into said hot-top toward the corners of said forming ingot.

* * * * *

UNITED STATES PATENT AND TRADEMARK OFFICE

CERTIFICATE OF CORRECTION

PATENT NO. : 4,236,570

DATED : December 2, 1980

INVENTOR(S) : Gerhart K. Gaule, John C. Yarwood, and Derek E. Tyler

It is certified that error appears in the above-identified patent and that said Letters Patent is hereby corrected as shown below:

In column 2, line 48, "According" should read --Accordingly--;

In column 2, line 56, "DRAWING" should read --DRAWINGS--.

In column 3, line 22, "section" should read --station--;

In column 3, line 34, "for" should read --the--.

In column 5, line 61, "embodients" should read --embodiments--.

In column 6, line 5, "providing" should read --pouring--;

In column 6, line 21, "allow" should read --alloy--.

Signed and Sealed this

Sixteenth Day of November 1982

[SEAL]

Attest:

GERALD J. MOSSINGHOFF

Attesting Officer

Commissioner of Patents and Trademarks